United States Patent [19]

Kasuga et al.

[11] 4,418,162

[45] Nov. 29, 1983

[54] PROCESS FOR TREATING THE SURFACE OF POLYACETAL RESIN

[75] Inventors: Takuzo Kasuga; Yukio Ikenaga; Masami Yamawaki, all of Fuji, Japan

[73] Assignee: Polyplastics Co., Ltd., Osaka, Japan

[21] Appl. No.: 339,454

[22] PCT Filed: Apr. 30, 1981

[86] PCT No.: PCT/JP81/00101

§ 371 Date: Dec. 28, 1981

§ 102(e) Date: Dec. 28, 1981

[87] PCT Pub. No.: WO81/03178

PCT Pub. Date: Nov. 12, 1981

[30] Foreign Application Priority Data

Apr. 30, 1980 [JP] Japan ..... 55-57280

[51] Int. Cl.[3] ..... C08K 9/04

[52] U.S. Cl. ..... 523/205; 524/422; 524/425; 524/542; 525/398

[58] Field of Search ..... 523/205; 524/422, 542, 524/425; 525/398

[56] References Cited

U.S. PATENT DOCUMENTS

| | | | |
|---|---|---|---|
| 3,248,271 | 4/1966 | Rielly et al. | 525/398 X |
| 3,255,060 | 6/1966 | Neumann et al. | 525/398 X |
| 3,763,084 | 10/1973 | Grudus et al. | 523/205 |

*Primary Examiner*—Lucille M. Phynes
*Attorney, Agent, or Firm*—Furuya & Co.

[57] ABSTRACT

A method for the surface treatment of polyacetal resin characterized in that the resin is treated with an acidic solution containing chloride ions and sulfuric acid ions can activate the surface so that the shaped article can be easily plated.

8 Claims, No Drawings

PROCESS FOR TREATING THE SURFACE OF POLYACETAL RESIN

TECHNICAL FIELD

The present invention relates to a method for the surface treatment of polyacetal resins. More particularly, the invention relates to a surface treatment method which is preferably adopted as the pre-treatment of polyacetal resins to be carried out prior to plating.

TECHNICAL BACKGROUND

Polyacetal resins have excellent thermal, mechanical and chemical properties. At the present time, however, since they are relatively expensive, they are mainly used as engineering resins for the manufacture of functional parts.

Looking to the future from the point of view of the raw materials for resins, it is expected that polyacetal resins formed by using methanol as the starting material will become one of the cheapest resins.

Therefore, it is expected that polyacetal resins will be applied even in those fields where ABS resins and the like are now applied, such as, for example, the manufacture of shaped articles decorated by plating and coating. In this field, however, the surface inactivity which is a merit of a polyacetal resin in the conventional uses becomes a defect. Therefore, the surface treatment of polyacetal resins is an important technical problem. By the term "surface treatment" is meant treatment which renders the surface hydrophilic so that plating or coating becomes possible.

It is said that polyacetal resins can be surface activated by etching with a chromic acid mixture, phosphoric acid, sulfonic acid or the like. However, although the surface is roughened by carrying out the etching according to such a conventional method, complete activation is impossible.

DISCLOSURE OF THE INVENTION

We carried out research on the relationship between changes of the surface by etching of a shaped article of a polyacetal resin and the kinds of treating agents. It was found that when a polyacetal resin is treated with a liquid mixture of hydrochloric acid and sulfuric acid good activation can be attained although use of each acid singly does not result in good activation, even with a thin depth of etching of less than several $\mu$m .

A polyacetal resin shaped article etched according to the method of the present invention can be plated by the same steps as those adopted for the plating of ABS resins. The plated article obtained has a high adhesion comparable to that of a plated ABS resin article and a heat resistance superior to that of a plated ABS resin article. Furthermore, the treated article can be surface-decorated and bonded, for example by coating, vacuum deposition or sputtering.

We have also carried out research on the composition of the polyacetal resin to be treated, and have found that a polyacetal resin containing calcium carbonate is especially preferred. By the use of this polyacetal resin, the effects of the present invention can be further enhanced.

More specifically, in accordance with the present invention, there is provided a method for the surface treatment of polyacetal resins, which comprises treating a shaped article of a polyacetal resin, preferably a polyacetal resin containing calcium carbonate, with an acidic solution containing chloride ions and sulfuric acid ions.

The treatment method of the present invention will now be described in detail.

In one embodiment of the present invention, a shaped article is prepared from a polyacetal resin according to a customary procedure, and the treatment of the present invention then carried out, preferably after annealing and degreasing. The treatment is ordinarily accomplished by dipping a shaped article of a polyacetal resin for a predetermined time in an acid solution of sulfuric acid containing chloride ions. For example, in the case of a liquid mixture of 1 part by volume of concentrated hydrochloric acid, 1 part by volume of concentrated sulfuric acid and 2 parts by volume of water (about 8.6% by weight of HCl plus about 35.3% by weight of $H_2SO_4$), the treatment is accomplished within 5 to 30 minutes at 25° C. The article treated according to the invention is subjected to neutralization and washing with water. It is then conveniently plated in the same was as in the case of ABS resin, that is by sensitization treatment, the activation treatment, the catalyst treatment including the sensitization treatment and the activation treatment in combination, the nonelectrolytic plating treatment and the electric plating. The treating condition is preferably 0°–70° C. in temperature and 1 min. to 1 hour in time, however adequately depends on combination of composition temperature and time of the treating solution. It is preferably selected according to steps to be conducted thereafter.

The polyacetal resin for use in the present invention may be, for example, a homopolymer, a copolymer or a modified acetal. Especially when a polyacetal resin contains calcium carbonate, the treated surface is appropriately rough and highly active, and therefore, the plating adhesion is remarkably high. The effect of improving the plating adhesion by calcium carbonate is highest when the content is 3% to 5%, and if the content is higher than this level, a good adhesion can be obtained stably. The addition of calcium carbonate results not only in stabilizing the plating adhesion but also improves the rigidity and reduces the dimensional change in the shaped article. A filler such as, for example, powder glass, silica, talc or pumice exerts similar effects. However, such filler involves a risk of reducing the surface gloss of the plated article. The calcium carbonate to be used in the present invention can be light calcium carbonate, chalk or heavy calcium carbonate. The kind of calcium carbonate may be chosen in respect to a particle size thereof according to the surface roughness allowed in view of a use purpose of an article moulded. Fine particulate products smaller than heavy calcium carbonate have a reduced action of degrading the gloss, but coarser particles are preferred from the viewpoint of the plating adhesion. Accordingly, when the surface gloss is important, it is preferred that the amount of calcium carbonate added be up to 10%, and when the rigidity and reduction of the dimensional change are important, it is preferred that the amount of the filler added be 10% to 60%.

The treating solution that is used in the present invention is ordinarily prepared from hydrochloric acid and sulfuric acid. However, the method of incorporation of chloride ions and sulfuric acid ions is not limited to mixing of the acids per se. For example, salts such as for example calcium chloride, sodium chloride and sodium sulfate may be added to an acidic solution to supply all or part of the necessary ions.

When such salts are used for formation of the acidic treating solution or when the treatment of a polyacetal resin containing calcium carbonate is repeated, it sometimes happens that precipitates are formed in the solution. In order to smooth the surface of the treated article, it is preferred that these precipitates be removed by filtration.

According to the surface-activating treatment of the present invention, the surface layer is etched preferably to a depth of 0.5 to 50 μm, more preferably 1 to 20 μm. A similar etching effect can be attained by the treatment using sulfuric acid or hydrochloric acid alone, but then the degree of activation is insufficient. It is a very interesting phenomenon that good activation can be attained only by the mixed acids of the present invention. It is considered that since the shaped article is simultaneously subjected to both the action of hydrochloric acid, having a relatively low etching activity but a high permeability, and the action of sulfuric acid, having a strong etching activity but a low permeability, the surface layer of the treated article is appropriately decomposed to form an active layer. However, the scope of the present invention is not limited by this conjecture. When the temperature and time of treatment are appropriately adjusted, the composition of the treating solution that is used for the treatment of the present invention can be changed within a broad range. For example, when the treatment temperature is 0° C. to 70° C., the treatment time is up to 1 hour and the solution is prepared from commercially available hydrochloric acid and sulfuric acid, it is preferred that the hydrogen ion concentration in the solution be 0.6 to 1.5 equivalents per 100 g [$0.02 \times H_2SO_4$ (wt.%)+0.027 HCl (wt.%)], especially 0.8 to 1.3 equivalents per 100 g, the hydrogen chloride/sulfuric acid weight ratio be from 1/20 to 20/1, especially from 1/10 to 1/1 and that the concentration of hydrogen chloride in the hydrochloric acid used be up to 30% and this hydrochloric acid be mixed with concentrated sulfuric acid (the especially preferred hydrogen chloride concentration being 7% to 25%). A solution having the intended composition may of course be prepared by mixing concentrated hydrochloric acid and concentrated sulfuric acid with water. The above-mentioned concentration range is not particularly critical, but this concentration range may be broadened if the treatment temperature is higher or lower than the above-mentioned temperature or the treatment time is shorter or longer. Phosphoric acid ions, sulfonic acid ions, boric acid ions, other halogen ions, halogenic acid ions, nitric acid ions, silicofluoric acid, borofluoric acid, organic acids such as for example formic acid, and organic materials such as for example surface active agents may be incorporated, so far as the effects of the present invention are not reduced.

The present invention will now be described with reference to the following Examples and Comparative Examples.

COMPARATIVE EXAMPLE 1

A plate having a side of 5 cm and a thickness of 3 mm was prepared from a polyacetal resin (Duracon M90 manufactured by Polyplastics Kabushiki Kaisha) by injection moulding. The shaped article was annealed at 140° C. for 1 hour and degreased with methylene chloride.

The degreased shaped article was treated at room temperature (25° C.) for 20 minutes with a liquid mixture comprising 1 part by volume of concentrated sulfuric acid and 1 part by volume of water, and was neutralized with a solution of sodium hydroxide, washed with water and treated at 25° C. for 3 minutes with Catalyst manufactured by Kizai Kabushiki Kaisha (1 part by volume of a catalyst, 1 part by volume of concentrated hydrochloric acid and 5 parts by volume of water) and at 25° C. for 2 minutes with a solution comprising 1 part by volume of concentrated hydrochloric acid and 3 parts by volume of water. Then, the article was nonelectrically plated with a solution manufactured by Kizai Kabushiki Kaisha (1 part by volume of chemical nickel plating solution A, 1 part by volume of chemical nickel plating solution B and 2 parts by volume of water) and electrically plated with copper (a solution comprising 220 g/l of copper sulfate and 55 g/l of concentrated sulfuric acid). The plated article was dried at 80° C. for 1 hour and the adhesion force was measured. It was found that the adhesion force was lower than 100 g/cm. The adhesion force was determined by forming a scar having a width of 1 cm with a knife so that the scar was extended to the resin layer from the plating surface and measuring the load necessary to peel the plated layer from the polyacetal.

COMPARATIVE EXAMPLE 2

The plating treatment was carried out in the same manner as in Comparative Example 1 except that a treating solution comprising 1 part by volume of concentrated hydrochloric acid and 1 part by volume of water was used. The adhesion force of the plated article was substantially zero.

EXAMPLE 1

The plating treatment was carried out in the same manner as in Comparative Example 1 except that a treating solution comprising 1 part by volume of concentrated sulfuric acid, 1 part by volume of 35% hydrochloric acid and 2 parts by volume of water was used. The adhesion force of the plated article was 700 g/cm.

EXAMPLES 2 TO 16

Polyacetal resins shown in Table 1 and treated under conditions shown in Table 1 were plated in the same manner as in Example 1. The results obtained are shown in Table 1.

TABLE 1

| Example No. | Base Resin | Additive | Amount (%) of Additive | Treating Solution (volume ratio) | Treatment Conditions | Adhesion Force (Kg/cm) |
|---|---|---|---|---|---|---|
| 2 | Delrin | — | — | sulfuric acid (1), hydrochloric acid (1), water (2) | 25° C. × 20 min | 0.5 |
| 3 | Duracon M90 | heavy calcium carbonate | 1 | sulfuric acid (1), hydrochloric acid | " | above 1 |

TABLE 1-continued

| Example No. | Base Resin | Additive | Amount (%) of Additive | Treating Solution (volume ratio) | Treatment Conditions | Adhesion Force (Kg/cm) |
|---|---|---|---|---|---|---|
| | | | | (1), water (2) | | |
| 4 | " | heavy calcium carbonate | 5 | sulfuric acid (1), hydrochloric acid (1), water (2) | " | above 2 |
| 5 | " | heavy calcium carbonate | 10 | sulfuric acid (1), hydrochloric acid (1), water (2) | " | above 2 |
| 6 | " | heavy calcium carbonate | 20 | sulfuric acid (1), hydrochloric acid (1), water (2) | " | above 2 |
| 7 | " | heavy calcium carbonate | 30 | sulfuric acid (1), hydrochloric acid (1), water (2) | " | 1.9 |
| 8 | " | heavy calcium carbonate | 10 | sulfuric acid (1), hydrochloric acid (1), water (2) | 25° C. × 10 min | 1.9 |
| 9 | " | heavy calcium carbonate | 10 | sulfuric acid (1), hydrochloric acid (1), water (2) | 25° C. × 30 min | 1.7 |
| 10 | " | heavy calcium carbonate | 10 | sulfuric acid (1), hydrochloric acid (1), water (2) | 35° C. × 5 min | 1.1 |
| 11 | " | heavy calcium carbonate | 10 | sulfuric acid (1), hydrochloric acid (1), water (2) | 45° C. × 5 min | 1.2 |
| 12 | " | heavy calcium carbonate | 10 | sulfuric acid (2), hydrochloric acid (1), water (2) | 25° C. × 5 min | 1.1 |
| 13 | " | heavy calcium carbonate | 10 | sulfuric acid (1), hydrochloric acid (2), water (2) | 25° C. × 10 min | 1.3 |
| 14 | " | Hakuenka DD* | 30 | sulfuric acid (1), hydrochloric acid (1), water (2) | 25° C. × 20 min | 1.5 |
| 15 | " | heavy calcium carbonate | 5 | sulfuric acid (1), hydrochloric acid (1), water (2) | " | 1.8 |
| | | glass beads | 30 | | | |
| 16 | " | Uniber* | 30 | sulfuric acid (1), hydrochloric acid (1), water (2) | " | 1.9 |

Note:
*finely divided calcium carbonate manufactured by Shiraishi Kogyo

We claim:

1. A method for the surface treatment of polyacetal resin characterized in that the resin is treated with an acidic solution containing chloride ions and sulfuric acid ions, wherein the hydrogen ion content of the solution is about 0.6 to about 1.5 equivalents per 100 grams of the solution and wherein the weight ratio of hydrogen chloride to sulfuric acid is about 1:20 to 20:1.

2. A method for the surface treatment according to claim 1, characterized in that the polyacetal resin is polyacetal containing calcium carbonate.

3. A method for the surface treatment according to claim 1, characterized in that the acidic solution is a mixed solution of hydrochloric acid and sulfuric acid.

4. A method for the surface treatment according to claim 1 wherein the hydrogen ion content is about 0.8 to about 1.3 equivalents per 100 grams of solution.

5. A method for the surface treatment according to claim 1 wherein the weight ratio of hydrogen chloride to sulfuric acid is about 1:10 to about 1:1.

6. A method for the surface treatment according to claim 1 wherein the acidic solution contains 1 part by volume of concentrated sulfuric acid, 1 part by volume of hydrochloric acid and 2 parts by volume of water.

7. A method for the surface treatment according to claim 1 wherein the resin is treated at a temperature of 0°-70° C. for about 1 minute to 1 hour.

8. A method for the surface treatment according to claim 1 wherein the resin is treated at a temperature of 25° C. for about 5 to 30 minutes.

* * * * *